United States Patent [19]

Brockage et al.

[11] Patent Number: 5,050,626

[45] Date of Patent: Sep. 24, 1991

[54] APPARATUS FOR CLEANING PAINT ROLLERS

[76] Inventors: John W. Brockage, 4008 Rhoda Ave., Oakland, Calif. 94602; Donald J. Brockhage, 1137 Park Brook Cir., Milpitas, Calif. 95035

[21] Appl. No.: 544,711

[22] Filed: Jun. 27, 1990

Related U.S. Application Data

[63] Continuation-in-part of Ser. No. 371,562, Jun. 28, 1989, abandoned.

[51] Int. Cl.[5] ..... B08B 3/02

[52] U.S. Cl. ..... 134/138; 134/149; 134/153; 134/155; 134/172; 134/182

[58] Field of Search ..... 15/250.32, 250.34; 403/330, 322; 134/138, 149, 139, 153, 155, 151, 172, 182; 68/213

[56] References Cited

U.S. PATENT DOCUMENTS

| | | | |
|---|---|---|---|
| 3,075,534 | 1/1963 | Habostad . | |
| 3,886,960 | 6/1975 | Krueger . | |
| 4,061,153 | 12/1977 | Doherty | 134/138 |
| 4,130,124 | 12/1978 | Sherwin | 134/138 |
| 4,294,272 | 10/1981 | Klairer | 134/138 |
| 4,377,175 | 3/1983 | Fritz | 134/138 |
| 4,402,333 | 9/1983 | Frizzell et al. | 134/138 |
| 4,521,255 | 6/1985 | Raymor et al. . | |
| 4,549,562 | 10/1985 | Ossi | 134/138 |
| 4,641,673 | 2/1987 | Conley et al. | 134/138 |
| 4,672,987 | 6/1987 | Brandl | 134/138 |
| 4,708,152 | 11/1987 | Hibberd | 134/138 |
| 4,711,258 | 12/1987 | Rossborough et al. | 134/138 |
| 4,809,722 | 3/1989 | Pennise | 134/138 |

*Primary Examiner*—Frankie L. Stinson

*Attorney, Agent, or Firm*—Townsend and Townsend

[57] ABSTRACT

The present invention is directed to an improved cleaner for a paint roller in which the cleaner includes a container with an opening for receiving a paint roller and a groove in the side wall thereof for releasably mounting the frame of the paint roller to the container, whereupon the roller is in a fixed location to be struck by water streams from a manifold within the interior of the body. The manifold is connected to a handle outside the container, and the handle is pivotally mounted so that the manifold can rotate through a limited arc to change the angle of impingement of the water streams from the manifold onto the paint roller to be cleaned. The handle of the container body has a serrated structure for releasably locking the handle to the body with a manifold in any one of a number of positions. Thus, depending upon the diameter of the roller, the angle of the water streams impinging from the manifold onto the roller to be cleaned can be varied so that paint rollers of different diameters can be accommodated with the apparatus of the present invention. In one embodiment of the apparatus, the roller rotates about a vertical axis and in a second embodiment, the roller rotates about a horizontal axis.

57 Claims, 7 Drawing Sheets

Fig. 7
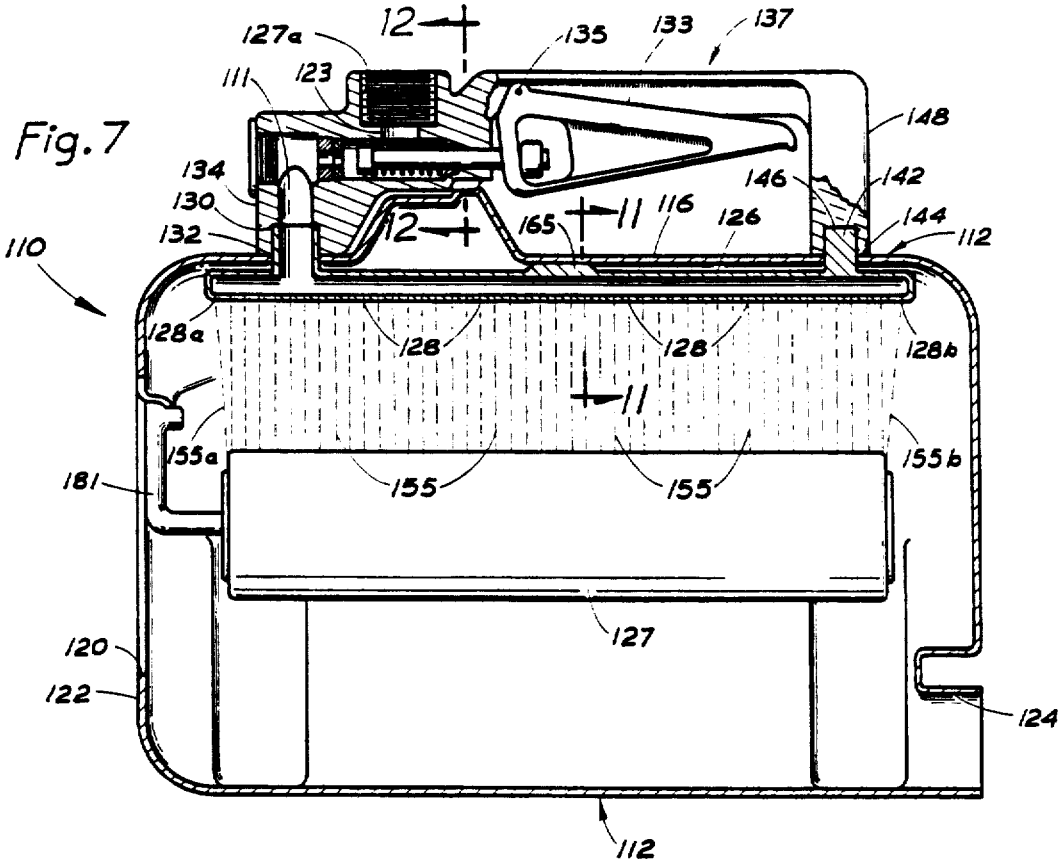
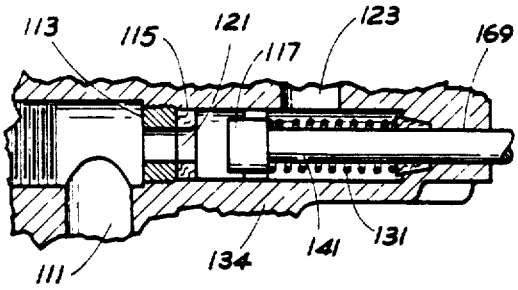
Fig. 10
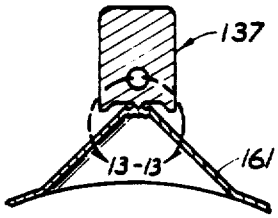
Fig. 12
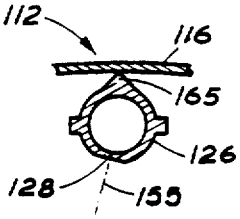
Fig. 11
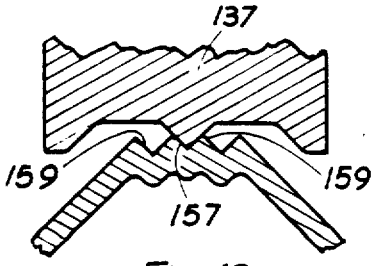
Fig. 13

Fig. 14
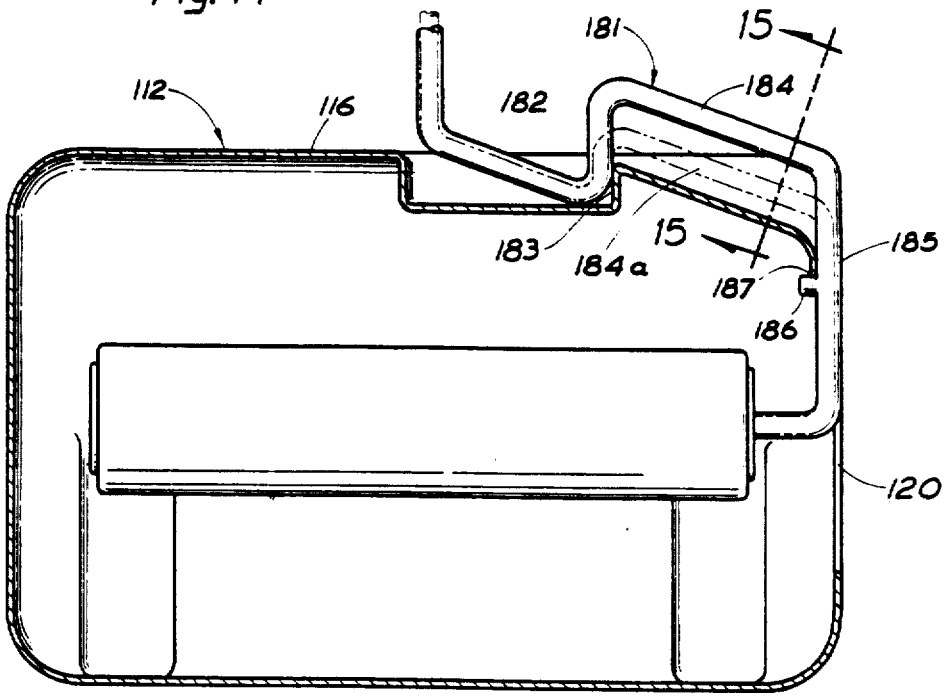
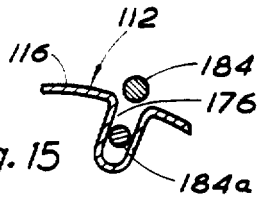
Fig. 15
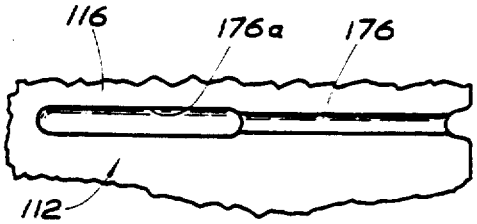
Fig. 16
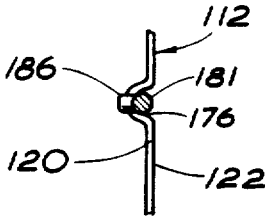
Fig. 17
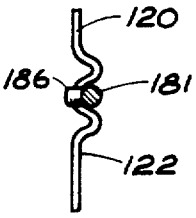
Fig. 18
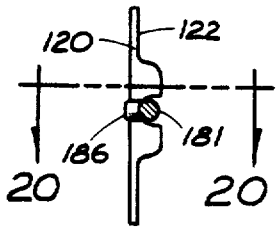
Fig. 19
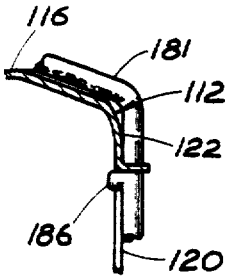
Fig. 20

APPARATUS FOR CLEANING PAINT ROLLERS

This is a continuation-in-part application of U.S. application Ser. No. 371,562 filed June 28, 1989, entitled "APPARATUS FOR CLEANING PAINT ROLLERS" now abandoned.

BRIEF DESCRIPTION OF THE INVENTION

This invention relates to improvements in the cleaning of paint dispensing devices and, more particularly, to apparatus for cleaning a conventional paint roller.

BACKGROUND OF THE INVENTION

Cleaning devices for paint rollers have been known and used in the past. Disclosures relating to this subject matter include U.S. Pat. Nos. 3,075,534, 3,886,960, 4,061,153 and 4,521,255.

In U.S. Pat. No. 3,075,534, a paint roller is mounted in a container for rotation about a vertical axis as water is supplied under pressure from a nozzle with the water being sprayed upon the roller itself to clean the roller. The nozzle is manually reciprocated in a vertical direction to cause water to be sprayed upon successive portions of the paint roller to be cleaned. An end wall has an opening (FIG. 2) for receiving the roller in a soaking mode.

U.S. Pat. No. 3,886,960 shows a paint cleaner having a fixed manifold for directing water streams onto a paint roller as the paint roller is reciprocated back and forth through the water streams.

U.S. Pat. No. 4,061,153 shows a paint roller cleaner with the roller being taken off the handle thereof and inserted between two end bearings in an enclosure. Water is directed into the enclosure and against the roller to be cleaned, causing the roller to rotate.

U.S. Pat. No. 4,521,255 discloses a mat cleaner in which two water jet assemblies are mounted on opposite sides of the mat and the mat is rotated at a sufficient speed to cause particles to leave the mat due to centrifugal force.

While the foregoing patents may be satisfactory in some cleaning operations, they are generally not sufficiently simple in construction and operation to render the cleaning of paint rollers of different diameters efficient and less time consuming. Thus, a need exists for improvements in cleaners for paint rollers which avoid the problems of the prior art. The present invention satisfies this need.

SUMMARY OF THE INVENTION

The present invention is directed to an improved cleaner apparatus for a paint roller in which the cleaner has a container with a opening for receiving the roller of a paint roller assembly and groove means in the wall of the container for releasably mounting the frame of the paint roller assembly to the container itself. Thus, the roller can be mounted in a fixed location in the container so that it can be struck by water streams from a manifold also within the container.

In a first embodiment of the apparatus, the opening for receiving the paint roller is a top opening and the roller rotates about a vertical axis. In a second embodiment, the opening is an end opening and the roller rotates about a horizontal axis.

The manifold is connected to a handle on the side wall of the container outside the interior thereof, and the handle is pivotally mounted on the container so that the manifold can rotate through a limited arc to change the angle of impingement of the water streams from the manifold onto the paint roller to be cleaned. Thus, rollers of different diameters can be cleaned by changing the angle of impingement of the water streams.

The handle of the container has a means for releasably locking the handle to the body with a manifold in any one of a number of angular positions. Thus, depending upon the diameter of the roller, the angle of the water streams from the manifold can be varied so that paint rollers of different diameters can be accommodated with the apparatus of the present invention.

The primary object of the present invention is to provide an improved paint roller cleaner apparatus which is simple and rugged in construction, can be operated without any special skills and has a relatively few number of moving parts so as to render the cleaner apparatus more efficient than prior art cleaners and yet the cleaner apparatus can be made inexpensively.

Other objects of this invention will become apparent as the following specification progresses, reference being made to the accompanying drawings for an illustration of the invention.

BRIEF DESCRIPTION OF THE DRAWINGS

FIG. 7 is a vertical section taken along line 7—7 of FIG. 6;

FIG. 10 is an enlarged, cross-sectional view of a portion of the valve assembly of FIG. 7;

FIG. 11 is a cross-sectional view taken along line 11—11 of FIG. 7;

FIG. 12 is a cross-sectional view taken along line 12—12 of FIG. 7;

FIG. 13 is an enlarged cross-sectional view taken along line 13—13 of FIG. 12;

FIG. 14 is a view similar to FIG. 7 showing the way in which the frame of the paint roller can be coupled to the container;

FIG. 15 is a cross-sectional view taken along line 15—15 of FIG. 14;

FIG. 16 is a top plan view of a portion of a groove in the container as shown in FIG. 15;

FIG. 17 is a cross-sectional view taken along line 17—17 of FIG. 6;

FIG. 18 is a view similar to FIG. 17 but showing an optional means for mounting a frame in the groove;

FIG. 19 is a view similar to FIG. 17 and 18 but showing a third means mounting a frame in the groove; and FIG. 20 is a fragment of cross-sectional view showing a way in which the frame of the paint roller is coupled by a projection the splash guard of the container assembly.

DETAILED DESCRIPTION OF THE DRAWINGS

Figures 1, 3, 4:
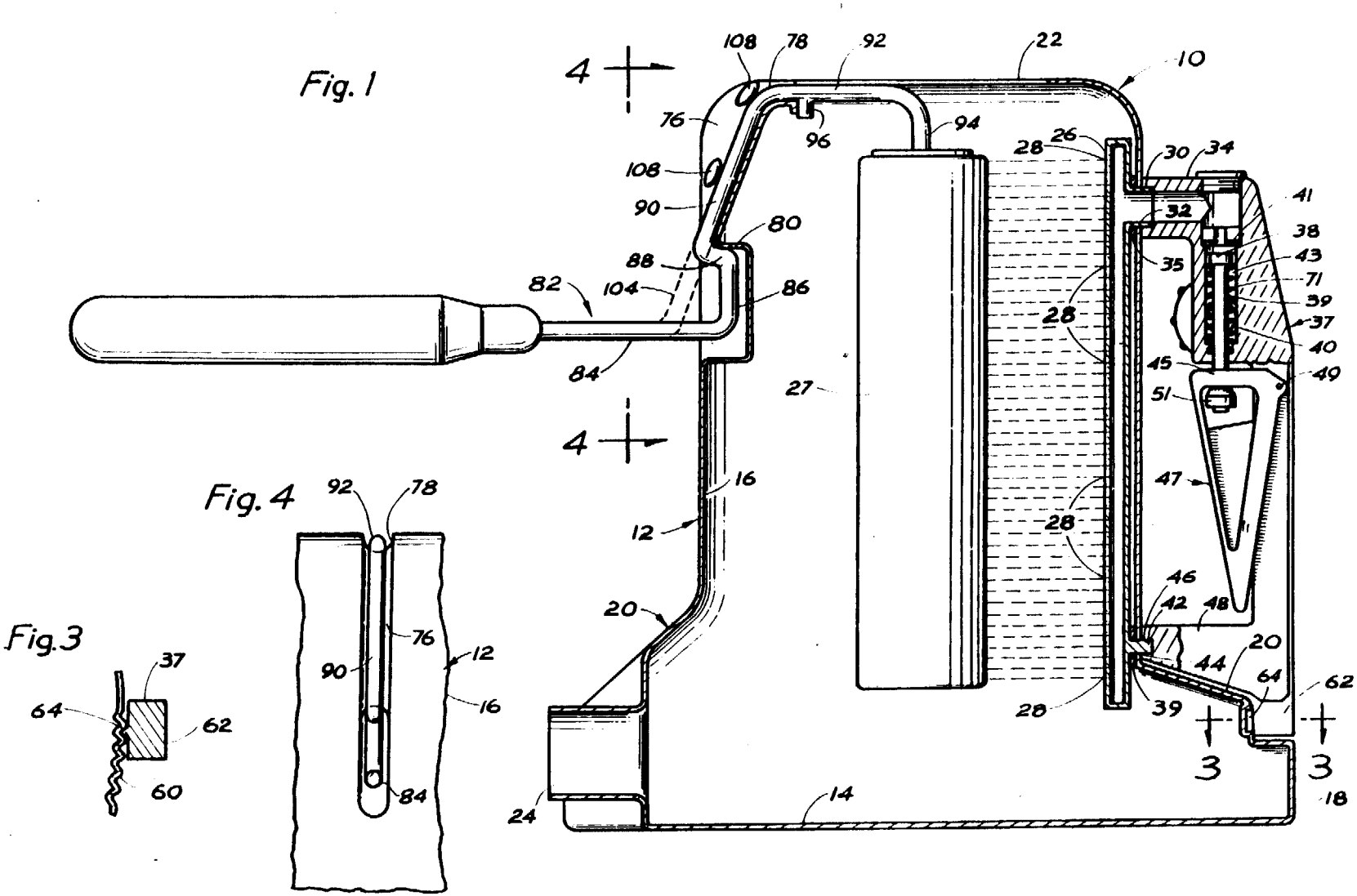
FIG. 1 is a vertical section through a first embodiment of the paint roller cleaner apparatus of the present invention showing a paint roller assembly with a specially shaped frame and a paint roller adapted to be rotated about a vertical axis, the view taken along line 1—1 of FIG. 2.
FIG. 3 is a cross-sectional view taken along line 3—3 of FIG. 1.
FIG. 4 is a cross-sectional view taken along line 4—4 of FIG. 1.

The paint roller cleaner apparatus, in a first embodiment of the present invention, is broadly denoted by the numeral 10 and includes a bell-shaped body or container 12 which has a bottom 14, a generally cylindrical side wall 16 and a base 18 having a sloping top wall 20 which is coupled to and extends downwardly from the lower margin of the side wall 16 as shown in FIG. 1. Body 12 can be formed of any suitable material, for example, a thin walled plastic, such as polyethylene. To this end, the body 12 can be blow molded to present a top opening 22 and a bottom, drain or outer opening 24 communicating with the interior of body 12 near bottom 14 thereof. The bottom is provided with a convex upper surface and a concave lower surface to permit the body to rest upon an irregular surface without tipping. The top opening 22 is surrounded by an annular top wall portion 23 which is flat and horizontal. Optionally, a conical wall portion (shown in dashed lines in FIG. 1) could be used as a splash guard to prevent splashing of water directed onto a paint roller to be cleaned as hereinafter described.

An elongated tube or manifold 26 is mounted vertically within body 12 near one inner portion of the side wall 16 thereof. Manifold 26 has a series of holes 27 therethrough, the holes being in vertical alignment with each other and spaced apart for directing individual streams of water onto a paint roller 27 mounted in the body 12 in a manner hereinafter described. Manifold 26 extends from a location close to but spaced below the top wall portion 23 (FIG. 1) and the lower end of manifold 26 is spaced upwardly from the upper surface of bottom 14.

Manifold 26 includes a first hollow tube segment 30 extending through an opening 32 in side wall 16 of body 12. Tube segment 30 is adapted to be coupled to and press fitted in the adjacent open end of an extension 34 at the upper end of a handle 37 having a valve 38 within the handle for controlling the flow of water from an inlet 40 in the handle, through extension 34, tube segment 30 and into and through manifold 26.

The lower part of manifold 26 has a projection 42 which extends through a hole 44 in side wall 16 directly above the upper annular periphery of sloping top wall 20 of base 18. Projection 42 is also press fitted and glued within an open end bore 46 of handle projection 48 extending laterally from a handle 37 directly above top wall 20 of base 18. Compressible washers 35 and 39 are mounted at the upper and lower parts of the handle to seal adjacent surfaces and facilitate pivotal movement of the handle about a generally vertical axis through openings 32 and 44 as hereinafter described.

Figure 2:
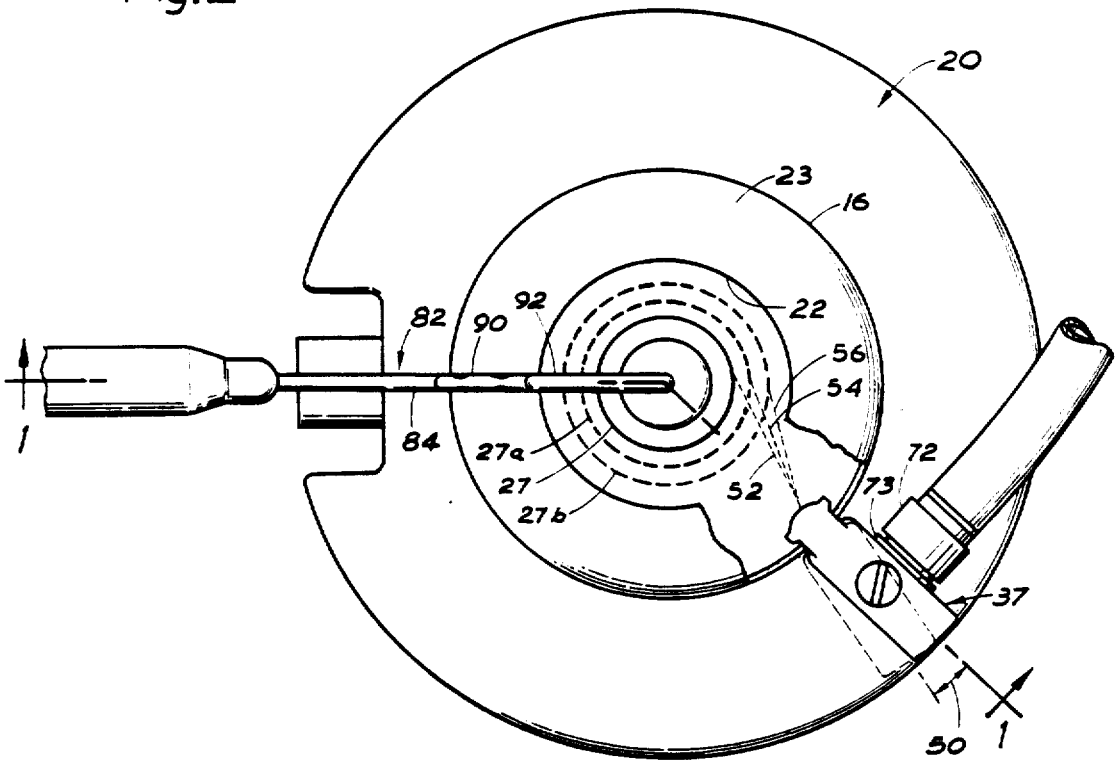
FIG. 2 is a top plan view of the paint roller cleaner apparatus of FIG. 1.

The fit provided by tube segment 30 in extension 34 and the fit provided by projection 42 in extension 48 allows the handle 37 to be rotated through a limited arc identified by the numeral 50 (FIG. 2). The angular movement is about a generally vertical axis through openings 32 and 44 (FIG. 1) and, because of the relatively rigid connection between tube segment 30 and extension 34 and the relatively rigid connection between projection 42 and extension 48 (FIG. 1) pivotal movement of handle 37 about a generally vertical axis also causes pivotal movement of manifold 26 about the same vertical axis. In this way, the streams of water from the holes 28 of manifold 26 can be moved from a first angle of tangential impingement as defined by the numeral 52 (FIG. 2) to a second angle of tangential impingement defined by the numeral 54 for a roller **27*a* of greater diameter. A stream line 56 is for a roller 27*b* of still greater diameter. When so directed against a paint roller 27, water streams from manifold 26** cause the roller to spin on its axis so that water will be certain to contact all surface portions of the roller to clean the roller.

As shown in FIG. 3, side wall 16 has a portion provided with serrations which define spaced projections 60. The lowest part 62 of handle 37 has a projection 64 thereon receivable within a space between each pair of adjacent projections 60. In this way, the handle 37 can be releasably locked in any one of a number of angular positions with respect to a radial line relative to the central axis of the side wall 16 of container 12. The handle 37 can be rotated about its vertical axis by applying a side force thereto to move projection 64 from one angular location to another. Projection 64, being non-yieldable, can move relative to projections 60, which are yieldably without damage to projections 60 or 64. The purpose of the serrations and the projection is to accommodate paint rollers of different diameters, such as rollers 27, **27*a* and 27*b* (FIG. 2**).

Valve member 38 is mounted on the upper end of a shaft 39 which is shiftably mounted for movement along the axis of the shaft to alternately seat and unseat valve member 38 with respect to valve seat 41. The lower end of rod 39 extends through the top part 45 of a trigger 47 pivotally mounted by a pin 49 on handle 37. A nut 51 is threadably mounted on the lower end of rod 39 to connect trigger 47 to valve 38. By grasping the trigger and forcing it in a counterclockwise sense when viewing FIG. 1, valve 38 is lowered and thereby opened. Thus, water can flow from a hose 70 connected to a source of water pressure (FIG. 2) through a fitting 72, into inlet 40 through passage 43 and into and through manifold 26. Release of the trigger will cause a coil spring 71 to return the trigger to its valve-closing position.

Body 12 has a side groove 76 in the side wall thereof and a top groove 78 in the top portion 23 thereof, grooves 76 and 78 being connected with each other. Groove 76 has the shape shown in FIG. 1 to present a generally horizontal shoulder 80 midway between the upper and lower ends of the groove 76. Paint roller 27 is mounted on a roller frame or handle 82 having a horizontal portion 84, a vertical portion 86, a linking portion 88, an inclined portion 90, another horizontal portion 92, and a second vertical portion 94. Portion 94 is coupled in any suitable manner to roller 27 for rotation of the roller about the longitudinal axis of portion 94.

Groove 76 receives vertical portion 86 and linking portion 88 as shown in FIG. 1, and a projection 96 on horizontal portion 92 is adapted to engage the inner periphery of opening 22 when linking portion 88 underlies shoulder 80. In this way and because of the resilience of the material which forms container side wall 16, frame 82 is releasably coupled to body 12 with roller 27 mounted with its axis generally vertical and coextensive with the central axis of the cylindrical side of body 12. When the roller is so mounted, inclined portion 90 of frame 82 is generally coincident with the inclined portion of groove 76 as shown in FIG. 1.

Figure 5:
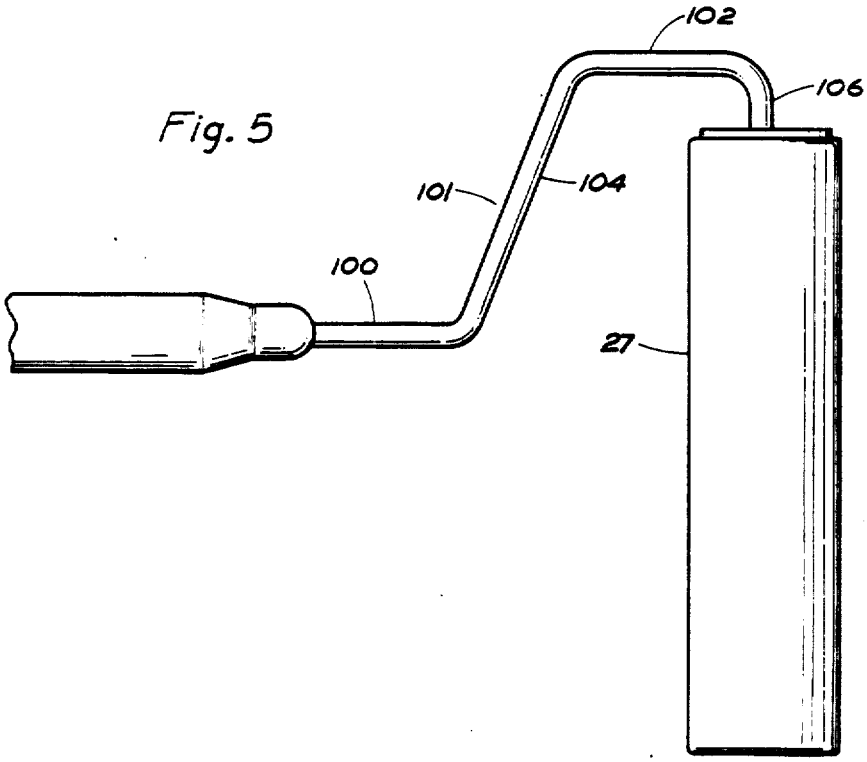
FIG. 5 is a paint roller assembly having a conventional handle.

While roller frame 82 is especially made for grooves 76 and 78, these grooves can be used to accommodate a paint roller frame of conventional construction as shown in FIG. 5. To this end, the conventional frame 101 has two horizontal portions 100 and 102, and inclined portion 104 and a vertical portion 106. Inclined portion 104 can be yieldably held in groove 76 as shown in dashed lines in FIG. 1, provided there are a pair of yieldable projections 108 in groove 76 as shown in FIG. 1. In such a case, the projections bias inclined portion 104 of frame 101 against the inner surface of the inclined portion of groove 76; thus, there is no need for shoulder 80 or projection 96 as required by the specially designed frame 82 of FIG. 1.

In use, apparatus 10 is coupled by hose 70 to a source of water under pressure with fitting 72 releasably coupled by screw threads to a fitting 73 coupled to handle 37. A paint roller of any diameter, such as paint roller 27 coupled to roller frame 82 (FIG. 1), is inserted into the body 12 through opening 22 at the top of the body. The roller frame 82 is tilted so that projection 96 is engageable with the inner periphery of top opening 22, then by forcing link 88 below shoulder 80, projection 96 will be moved into engagement with the inner periphery of top opening 22, and roller frame 82 will be releasably coupled to side wall 16 with paint roller 27 substantially coincident with the central axis of cylindrical side wall 16 as shown in FIG. 1. Then, the user pivots trigger 47 to open the tube and cause flow of water into and through manifold 26, whereupon the streams of water are adapted so that they impinge upon the paint roller and cause it to spin by virtue of the tangential relationship between the water streams and the outer periphery of the paint roller. The adjustment is made by pivoting the handle 37 so that tangential impingement of the water streams on the roller is assured. This can be observed by looking in the container 12 through the open top thereof.

The excess water drips from the paint roller onto the bottom 14 of body 12, whereupon outlet 24 is coupled to a suitable reservoir or waste disposal tank to direct paint-laden water out of body 12.

If desired, a conventional paint roller, as shown in FIG. 5, can be used in place of the paint roller shown in FIG. 1. In such a case, the paint roller frame 101 will assume the dashed line position of FIG. 1 and be pressed against the projections 108 which yieldably hold the frame 101 in position with the paint roller 27 in the position shown in FIG. 1.

Figure 6:
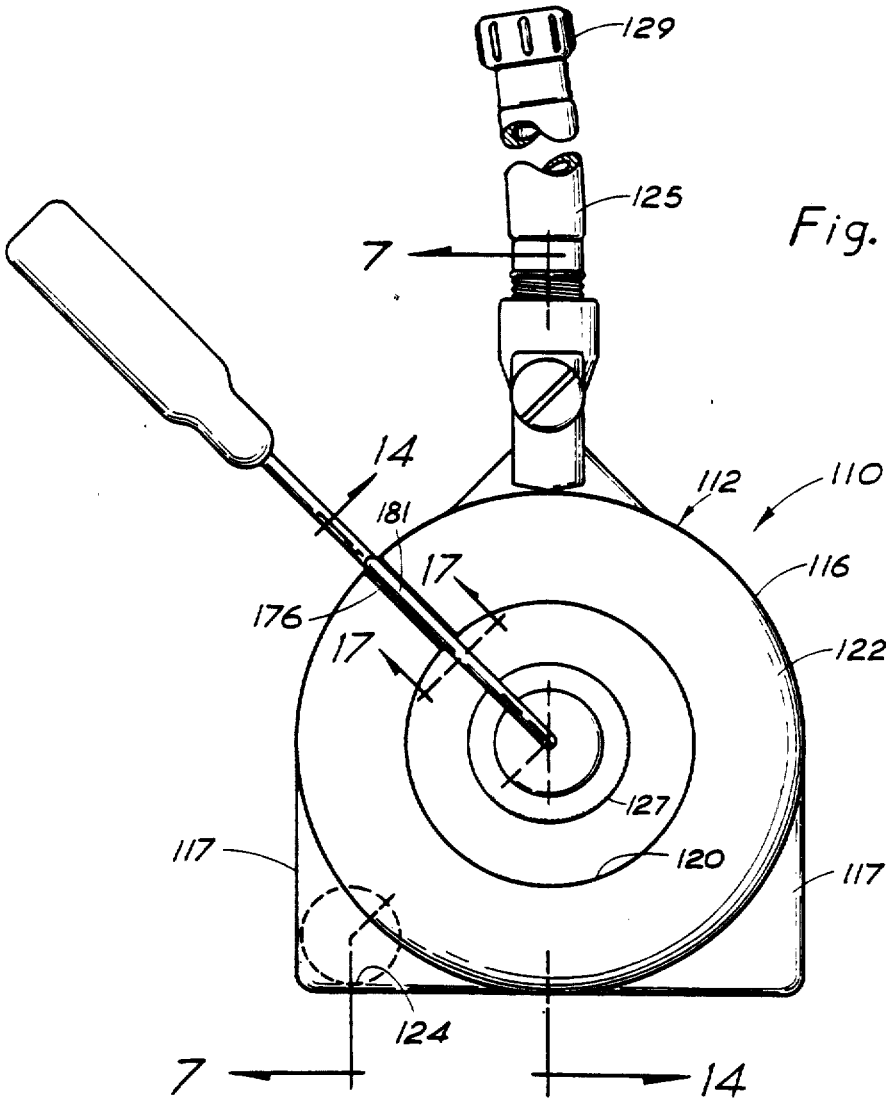
FIG. 6 is an end elevational view of a second embodiment of the paint roller cleaner apparatus of the present invention, showing a container with an end wall opening for receiving a paint roller, with the paint roller being mounted on a horizontal axis for rotation relative to the container.

A second embodiment of the paint roller cleaner apparatus of the present invention is broadly denoted by the numeral 110 and includes a hollow body or container 112 which has a generally cylindrically side wall 116 and a pair of projections 117 on the side wall as shown in FIG. 6 so that the body or container 112 can rest on a support surface, such as the bottom of a kitchen sink or the sink of a laundry room or the like.

Body 112 can be formed of any suitable material, for example, a thin walled plastic, such as polyethylene. To this end, the body 112 can be blow molded to present an end opening 120 in an end wall 122 and a bottom or drain opening 124 communicating with the interior of container 112 near the bottom thereof as shown in FIGS. 6 and 7. End opening 120 is adapted to receive a paint roller 127 as hereinafter described.

An elongated tube or manifold 126 is mounted within container 112 near the inner surface of cylindrical side wall 116 near the upper portion thereof as shown in FIG. 7. Manifold 126 is generally horizontal when projections 117 rest upon a horizontal surface. Manifold 126 also has a series of holes 128 therethrough, the holes being in alignment with each other and spaced apart for directing individual streams of liquid or water onto paint roller 127 mounted in container 112 for rotation about a generally horizontal axis as shown in FIGS. 6 and 7. The paint roller 127 has a frame 181 which is releasably coupled to container 112 to support the paint roller 127 for rotation about a horizontal axis in the manner shown in FIGS. 6 and 7 with the inner end of the paint roller 127 being unsupported.

Manifold 126 includes a first hollow tubular segment or projection 130 (FIG. 7) extending through an opening 132 in side wall 116 in the top portion thereof. Tubular segment 130 is adapted to be coupled to and press fitted in and sealed to the adjacent open end of an extension 134 at one end of handle 137 (FIG. 7).

The opposite end of manifold 126 has a projection 142 which extends through a hole 144 in side wall 116. Projection 142 is also press fitted and glued within an open end bore 146 of a handle projection 148 on handle 137 as shown in FIG. 7. Projection 142 seals the adjacent surfaces of handle projection 148 and allows pivotal movement of handle 137 and manifold 126 about a generally horizontal axis through openings 132 and 144 as hereinafter described.

The fit provided by tubular segment 130 and extension 134 and the fit provided by projection 142 and extension 148 allow handle 137 to be rotated about the above-mentioned horizontal axis through a limited arc relative to container 112. The angular movement of handle 137 is about a generally horizontal axis through openings 132 and 144 (FIG. 7) and because of the relatively rigid connection between the tubular segment and 130 and extension 134 and the relatively rigid connection between projection 142 and extension 148 (FIG. 7) pivotal movement of handle 137 about a generally horizontal axis also causes pivotal movement of manifold 126 about the same horizontal axis. In this way, streams of liquid or water from the holes 128 of manifold 126 can be moved from a first operative position at which the liquid streams are at a first angle of tangential impingement on the paint roller 127 to other operative positions at which the liquid streams are at other angles of tangential impingement. Stream lines 155 are shown in FIG. 7 as emanating from holes 128 and, when the stream lines of the liquid are directed against paint roller 127, the stream lines will cause the roller to spin on its axis so that the water will be certain to contact all surface portions of the roller to clean the roller.

It is to be noted that the end holes 128*a* and 128*b* (FIG. 7) of the manifold are arranged so that the streamlines 155*a* and 155*b* therefrom are at angles with respect to the other streamlines 155 as shown in FIG. 7. The purpose of the angled streamlines 155*a* and 155*b* is to clean the ends of the roller 127 and to apply an axial force component to the roller 127 so as to cause the roller to move back and forth along its horizontal axis to prevent tracking of the streams 155 and to thereby cause the streams 155 to contact different portions of the paint roller 127.

Handle 137 has extension 134 integral therewith, the extension having a bore 111 (FIGS. 7 and 10) which has a threaded washer 113 holding an annular valve seat 115 in place so that a valve member 117 which is shiftably mounted in a bore 119 in extension 134 can move axially and toward and away from valve seat 115. When valve member 117 engages valve seat 115, it closes the central hole 121 in the valve seat and thereby cuts off the flow of water through a lateral bore 123 (FIGS. 7 and 10) from a hose 125 threadably coupled into a fitting 127 (FIG. 7), the outer end of the hose 125 having a fitting 129 for attachment to another hose coupled to a source of water under pressure. A coil spring 131 biases valve member 117 toward valve seat 115 as shown in FIG. 10.

A trigger 133 is pivotally mounted by a pin 135 on handle 137 and the front end 139 of the trigger is coupled by a nut 131 to the rear end of the shaft 141 of valve member 117 so that when the trigger is rotated in a counterclockwise when viewing FIG. 7, the valve defined by valve seat 115 and valve member 117 is opened to allow water to flow into and through the handle and into and through the manifold 126 and out of the manifold through holes 128, **128*a* and 128*b***.

As shown in FIGS. 7, 12 and 13, handle 137 has a projection 157 which is received within any one of a number of recesses 159 in the upper portion of a hollow extension 161 of side wall 116 as shown in FIG. 7. The recesses 159 receive projection 157. Sidewall 116 is yieldable so that the projection 157, serving as a releasable lock, is adapted to be received in any one of the recesses 159 as a function of the pivotal or rotative position of handle 137 relative to container 112. In this way, the handle 137 can be releasably locked in any one of a number of angular positions with respect to body 112. The handle 137 can be rotated about a horizontal axis by applying a side force thereto to move projection 157 from one recess 159 to the next adjacent recess 159. Each projection between each pair of recesses 159 is non-yieldable so that the yieldable tip 157 can move readily from one recess 159 to the other recess 159. The purpose of the recesses 159 and the projection 157 is to accommodate paint rollers of different diameters.

Manifold 126 has a rib 165 (FIGS. 7 and 11) for engaging the inner surface of side wall 116 as shown in FIG. 11. This braces the central part of the manifold and supports it for rotation relative to side wall 116.

Container 112 has a side groove 176 (FIGS. 6, 14, 15 and 16). The groove 176 is adapted to at least partially contain a portion of the frame 181 of the paint roller 127.

Frame 181 includes a first vertical part 182 which is adapted to engage a shoulder 183 forming part of groove 176. The vertical portion 182 is coupled to an inclined frame portion 184 which is normally out of the groove 176 as shown in FIG. 15 and frame portion 184 is coupled to a transverse part 185 having a tip 186 which snaps over the end edge 187 of the side wall 116 defining the end opening 120 (FIGS. 6 and 7).

The foregoing explanation is for a frame 181 which is typically ⅜" in diameter. For a frame having a diameter of about ¼", frame portion **184*a* is provided in groove 176 as shown in FIG. 15 and eliminates the need for shoulder 183 but still requires projection 186. FIG. 16 shows the relatively shorter smaller diameter of groove 176 for receiving the ¼" diameter frame; whereas, the rear part of groove 176, denoted by the numeral 176*a*, shows a larger diameter for receiving the rear portion 181*a* of frame 181**.

FIGS. 17-19 show alternative embodiments of the groove 176 for receiving the ¼" frame as well as the ⅜" frame. FIG. 20 shows the way in which the frame can be fitted into a groove 176 of relatively short length yet the frame can still have a projection 186.

An important feature of the present invention is the use of the curved, annular end wall 122 (FIGS. 6 and 7) on container 112. End wall 122 defines a splash guard which prevents water from sloshing and splashing out of the interior of container 112 as paint roller 127 rotates about a horizontal axis.

In use, apparatus 110 is coupled by a fitting 129 (FIG. 6) to a hose so that the apparatus can be coupled to a source of liquid or water under pressure. A paint roller of any diameter, such as the paint roller 127 coupled to roller frame 181, is inserted into body 112 through end opening 120. Roller frame 181 is coupled in any suitable manner, such as by any one of the ways shown in FIGS. 14–20 so as to mount the paint roller with its axis generally horizontal and coincident with the central axis of body 112. Then, water or other liquid is caused to flow under pressure through manifold tube 126, whereupon streams of water 155 will impinge upon paint roller 127 and cause it to spin by virtue of the tangential relationship between the water or liquid streams on the outer periphery of the paint roller 127. The adjustment of the angle of impingement is made by pivoting handle 137 so that tangential impingement of the water streams on the roller is assured. This can be observed by looking into the container through the end opening 120 thereof.

Excess water or liquid drips from the paint roller 127 onto the inner surface of body 112, whereupon outlet 124 is coupled to a suitable reservoir or waste disposal tank to direct paint-laden water out of body 112. As the paint roller rotates, the splash guard defined by end wall 122 prevents water from sloshing out or splashing out of the container 112 and protects adjacent surfaces from contamination by the paint laden water.

Figure 8:
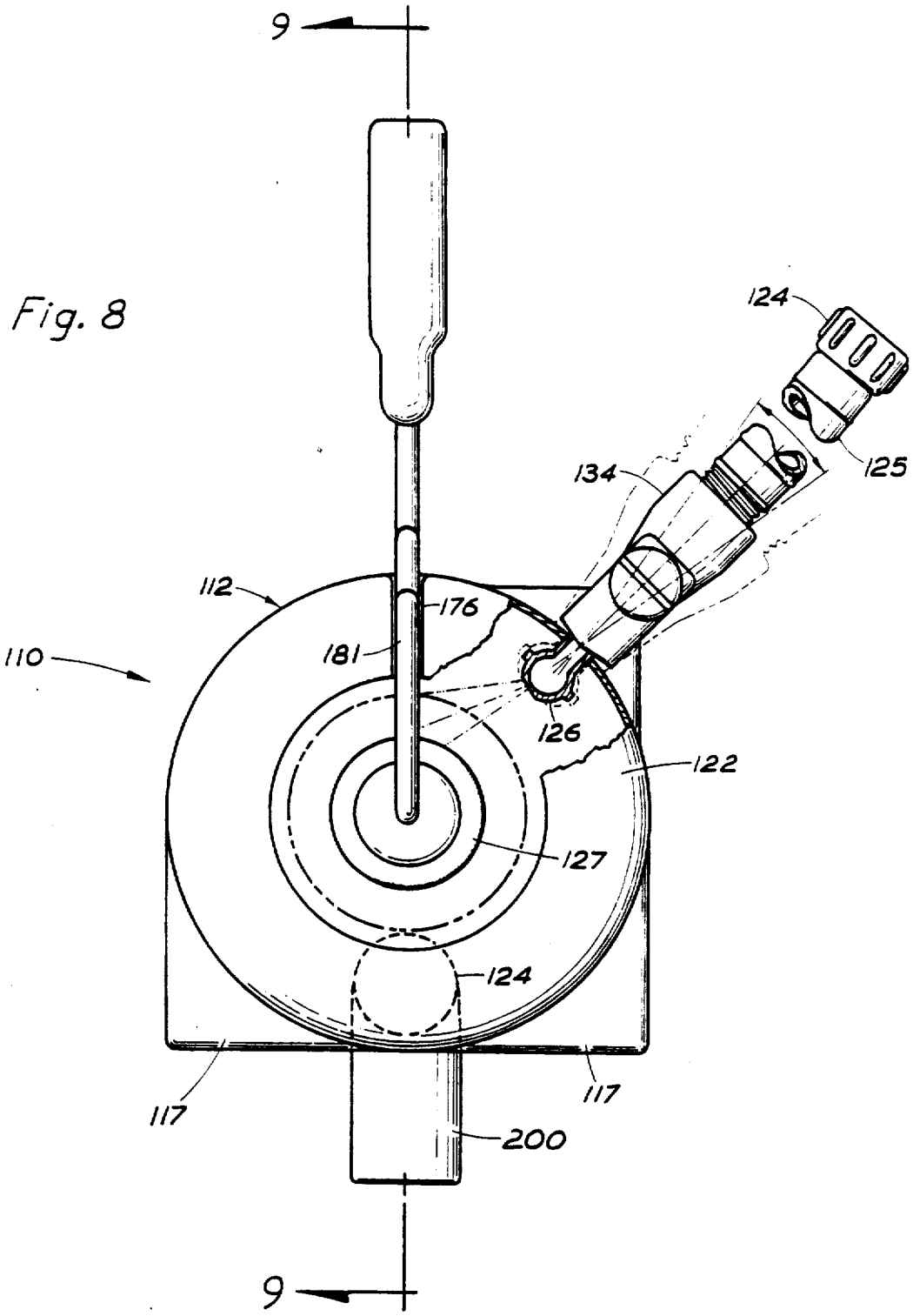
FIG. 8 is a view similar to FIG. 6 but showing the frame of the paint roller cleaner assembly being generally vertical as contrasted with an inclined frame in FIG. 6.
Figure 9:
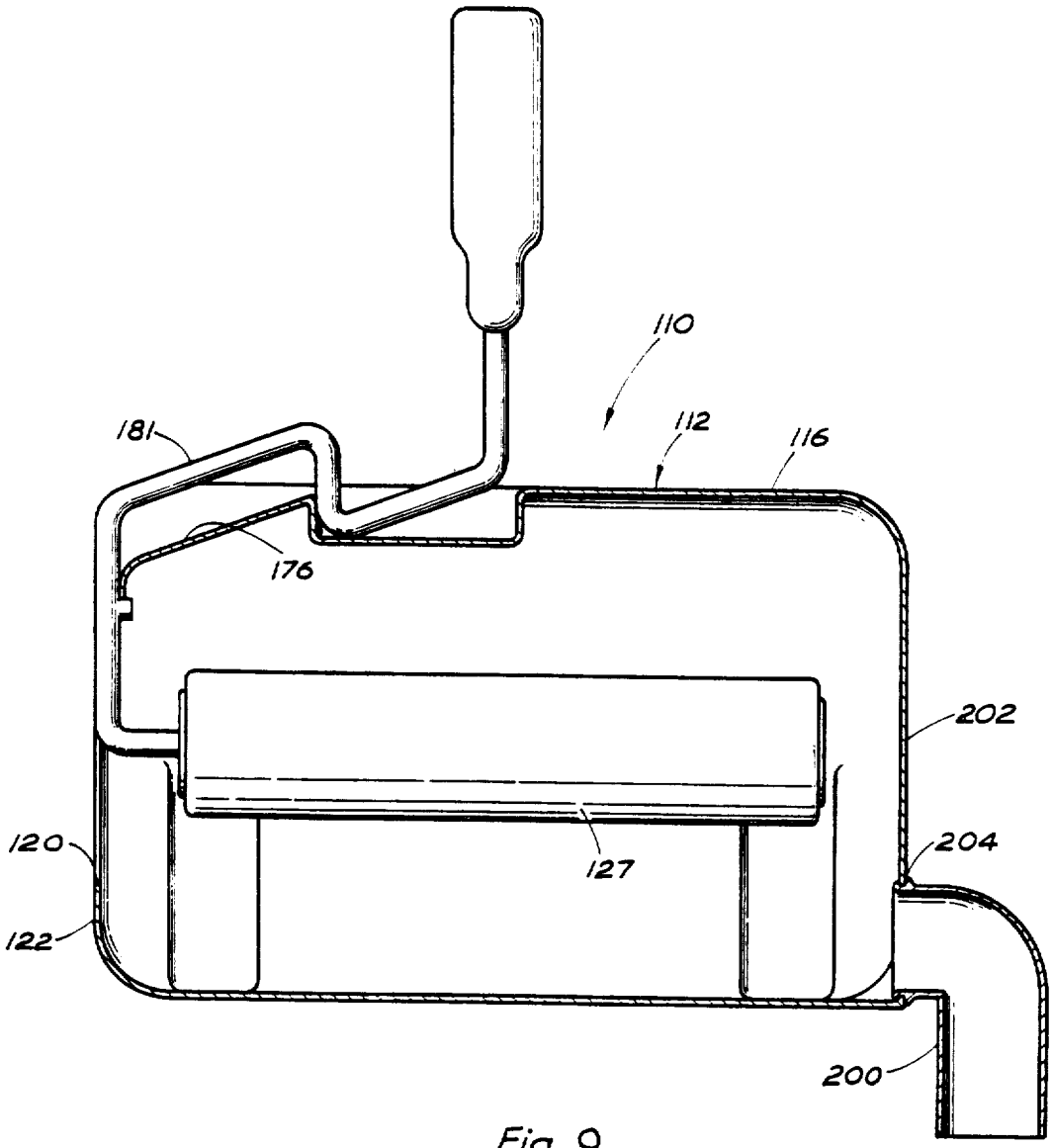
FIG. 9 is a cross-sectional view taken along line 9—9 of FIG. 8.

FIGS. 8 and 9 shows a modified version of apparatus 10 in which the paint roller frame is at a 12 o'clock position and the manifold 126 and handle 137 are at 2 o'clock positions. The operation of the apparatus of FIGS. 8 and 9 is substantially the same as that described above with respect to the embodiment of FIGS. 6 and 7. In the case of the embodiment of FIGS. 8 and 9, the drain opening is centrally located as shown in FIG. 8 and an L-shaped tube 200 can be releasably connected to the container back wall 202 to form an outlet for the container.

We claim:

1. Apparatus for use in cleaning a roller of a paint roller assembly comprising:

a container having an opening for receiving the roller;

means on the container and adapted to be coupled with the paint roller assembly for mounting the roller of the assembly in the container for rotation about the central axis of the roller;

a manifold in the container and having a plurality of holes therethrough to permit water to be directed out of the manifold under pressure and onto a roller in the container; and a handle carried by the container and coupled with the manifold, said container handle being mounted on the container for pivotal movement about a second axis, there being means defining a fluid passage communicating with the manifold and adapted to be coupled with a source of water under pressure.

2. Apparatus as set forth in claim 1, wherein said manifold has a central axis, said second axis being parallel with and spaced laterally of the central axis of the manifold, whereby the angle of the water streams from the holes of the manifold can be varied for accommodating rollers of different diameters.

3. Apparatus as set forth in claim 2, wherein said manifold has a pair of spaced projections, said container having a side wall, the projections being pivotally mounted in the side wall for limited rotation about said second axis.

4. Apparatus as set forth in claim 3, wherein one of the projections is tubular and is in fluid communication with the manifold and the fluid passage.

5. Apparatus as set forth in claim 2, wherein is included means for releasably locking the handle and thereby the manifold in any one of a number of operative positions relative to the container.

6. Apparatus as set forth in claim 5, wherein said locking means includes a serrated surface on the container and a projection on the handle for engaging said serrated surface.

7. Apparatus as set forth in claim 1, wherein is included valve means carried by the handle for selectively controlling the flow of water through the fluid passage.

8. Apparatus as set forth in claim 7, wherein said manifold has a central axis, said second axis being parallel with and spaced laterally of the central axis of the manifold, whereby the angle of the water streams from the holes of the manifold can be varied for accommodating rollers of different diameters.

9. Apparatus as set forth in claim 8, wherein said manifold has a pair of spaced projections, said container having a side wall, the projections being pivotally mounted in the side wall for limited rotation about said second axis.

10. Apparatus as set forth in claim 9, wherein one of the projections is tubular and is in fluid communication with the manifold and the fluid passage in the handle.

11. Apparatus as set forth in claim 8, wherein is included means for releasably locking the handle and thereby the manifold in any one of a number of operative positions relative to the container.

12. Apparatus as set forth in claim 11, wherein said locking means includes a serrated surface on the container and a projection on the handle for engaging said serrated surface.

13. Apparatus as set forth in claim 7, wherein said valve means includes a valve member, a trigger pivotally mounted on the handle, and means coupling the trigger to the valve member to open the valve member when the trigger is rotated in one direction with respect to the handle.

14. Apparatus as set forth in claim 1, wherein said container has a side wall provided with a groove, said paint roller assembly having a frame receivable in the groove when the roller is in the container, and means for releasably holding said frame of the paint roller assembly in the groove.

15. Apparatus as set forth in claim 14, wherein said holding means includes a projection on the frame for engaging the container at the inner periphery of the opening thereof, and means on the container for forming a shoulder in the groove for engaging a lateral projection on the frame.

16. Apparatus as set forth in claim 1, wherein the groove has an inclined portion for receiving an inclined segment of the frame of the paint roller assembly.

17. Apparatus as set forth in claim 16, wherein the container has a pair of projections in the groove for releasably holding the inclined segment of the frame in the groove.

18. Apparatus as set forth in claim 1, wherein the axes are substantially vertical.

19. Apparatus as set forth in claim 1, wherein the axes are substantially horizontal.

20. Apparatus as set forth in claim 1, wherein said opening is at the top of the container.

21. Apparatus as set forth in claim 1, wherein said opening is at one end of the container.

22. Apparatus as set forth in claim 21, wherein the container has an end wall provided with said opening, said end wall defining a splash guard for keeping water in the container as the roller rotates relative thereto.

23. Apparatus for use in cleaning a roller of a paint roller assembly comprising:

a container having a top opening for receiving the roller;

means on the container and adapted to be coupled with the paint roller assembly for mounting the roller of the assembly in the container for rotation about a first, generally vertical axis;

a manifold in the container and having a plurality of holes therethrough to permit water to be directed out of the manifold under pressure and onto a roller in the container; and a handle carried by the container and coupled with the manifold, said container handle being mounted on the container for pivotal movement about a second, generally vertical axis, said container handle having a fluid passage communicating with the manifold and adapted to be coupled with a source of water under pressure.

24. Apparatus as set forth in claim 23, wherein said manifold has a central axis, said second axis being parallel with and spaced laterally of the central axis of the manifold, whereby the angle of the water streams from the holes of the manifold can be varied for accommodating rollers of different diameters.

25. Apparatus as set forth in claim 24, wherein said manifold has a pair of spaced projections, said container having a side wall, the projections being pivotally mounted in the side wall for limited rotation about said second axis.

26. Apparatus as set forth in claim 25, wherein one of the projections is tubular and is in fluid communication with the manifold and the fluid passage in the handle.

27. Apparatus as set forth in claim 24, wherein is included means for releasably locking the handle and thereby the manifold in any one of a number of operative positions relative to the container.

28. Apparatus as set forth in claim 27, wherein said locking means includes a serrated surface on the container and a projection on the handle for engaging said serrated surface.

29. Apparatus as set forth in claim 23, wherein is included valve means carried by the handle for selectively controlling the flow of water through the fluid passage of said handle.

30. Apparatus as set forth in claim 29, wherein said manifold has a central axis, said second axis being parallel with and spaced laterally of the central axis of the manifold, whereby the angle of the water streams from the holes of the manifold can be varied for accommodating rollers of different diameters.

31. Apparatus as set forth in claim 30, wherein said manifold has a pair of spaced projections, said container having a side wall, the projections being pivotally mounted in the side wall for limited rotation about said second axis.

32. Apparatus as set forth in claim 31, wherein one of the projections is tubular and is in fluid communication with the manifold and the fluid passage in the handle.

33. Apparatus as set forth in claim 30, wherein is included means for releasably locking the handle and thereby the manifold in any one of a number of operative positions relative to the container.

34. Apparatus as set forth in claim 33, wherein said locking means includes a serrated surface on the container and a projection on the handle for engaging said serrated surface.

35. Apparatus as set forth in claim 29, wherein said valve means includes a valve member, a trigger pivotally mounted on the handle, and means coupling the trigger to the valve member to open the valve member when the trigger is rotated in one direction with respect to the handle.

36. Apparatus as set forth in claim 23, wherein said container has a side wall provided with a groove, said paint roller assembly having a frame receivable in the groove when the roller is in the container, and means for releasably holding said frame of the paint roller assembly in the groove.

37. Apparatus as set forth in claim 36, wherein said holding means includes a projection on the frame for engaging the container at the inner periphery of the opening thereof, and means on the container for forming a shoulder in the groove for engaging a lateral projection on the frame.

38. Apparatus as set forth in claim 36, wherein the groove has an inclined portion for receiving an angled segment of the frame of the paint roller assembly.

39. Apparatus as set forth in claim 38, wherein the container has a pair of projections in the groove for releasably holding the inclined segment of the frame in the groove.

40. Apparatus for use in cleaning a roller of a paint roller assembly comprising:

a container having an end opening for receiving the roller;

means on the container and adapted to be coupled with the paint roller assembly for mounting the roller of the assembly in the container for rotation about a first, generally horizontal axis;

a manifold in the container and having a plurality of holes therethrough to permit water to be directed out of the manifold under pressure and onto a roller in the container; and a handle carried by the container and coupled with the manifold, said container handle being mounted on the container for pivotal movement about a second, generally horizontal axis, said container handle having a fluid passage therethrough communicating with the manifold and adapted to be coupled with a source of water under pressure.

41. Apparatus as set forth in claim 40, wherein said manifold has a central axis, said second axis being parallel with and spaced laterally of the central axis of the manifold, whereby the angle of the water streams from the holes of the manifold can be varied for accommodating rollers of different diameters.

42. Apparatus as set forth in claim 41, wherein said manifold has a pair of spaced projections, said container having a side wall, the projections being pivotally mounted in the side wall for limited rotation about said second axis.

43. Apparatus as set forth in claim 42, wherein one of the projections is tubular and is in fluid communication with the manifold and the fluid passage in the handle.

44. Apparatus as set forth in claim 41, wherein is included means for releasably locking the handle and thereby the manifold in any one of a number of operative positions.

45. Apparatus as set forth in claim 44, wherein said locking means includes a serrated surface on the container and a projection on the handle for engaging said serrated surface.

46. Apparatus as set forth in claim 40, wherein is included valve means carried by the handle for selectively controlling the flow of water through the fluid passage of said handle.

47. Apparatus as set forth in claim 46, wherein said manifold has a central axis, said second axis being parallel with and spaced laterally of the central axis of the manifold, whereby the angle of the water streams from the holes of the manifold can be varied for accommodating rollers of different diameters.

48. Apparatus as set forth in claim 47, wherein said manifold has a pair of spaced projections, said container having a side wall, the projections being pivotally mounted in the side wall for limited rotation about said second axis.

49. Apparatus as set forth in claim 48, wherein one of the projections is tubular and is in fluid communication with the manifold and the fluid passage in the handle.

50. Apparatus as set forth in claim 47, wherein is included means for releasably locking the handle and thereby the manifold in any one of a number of operative positions relative to the container.

51. Apparatus as set forth in claim 50, wherein said locking means includes a serrated surface on the container and a projection on the handle for engaging said serrated surface.

52. Apparatus as set forth in claim 46, wherein said valve means includes a valve member, a trigger pivotally mounted on the handle, and means coupling the trigger to the valve member to open the valve member when the trigger is rotated in one direction with respect to the handle.

53. Apparatus as set forth in claim 40, wherein said container has a side wall provided with a groove, said paint roller assembly having a frame receivable in the groove when the roller is in the container, and means for releasably holding said frame of the paint roller assembly in the groove.

54. Apparatus as set forth in claim 53, wherein said holding means includes a projection on the frame for engaging the container at the inner periphery of the opening thereof, and means on the container for forming a shoulder in the groove for engaging a lateral projection on the frame.

55. Apparatus as set forth in claim 53, wherein the groove has an inclined portion for receiving an inclined segment of the frame of the paint roller assembly.

56. Apparatus as set forth in claim 55, wherein the container has a pair of projections in the groove for releasably holding the inclined segment of the frame in the groove.

57. Apparatus as set forth in claim 40, wherein the container has an end wall with said opening therethrough, said end wall defining a splash guard to keep water in the container as the roller rotates relative thereto.

* * * * *